US007819264B2

(12) United States Patent
Brozell et al.

(10) Patent No.: US 7,819,264 B2
(45) **Date of Patent: *Oct. 26, 2010**

(54) CHILD-RESISTANT CLOSURE, CONTAINER AND PACKAGE

(75) Inventors: Brian J. Brozell, Maumee, OH (US); Stephen A. Eilertson, Perrysburg, OH (US)

(73) Assignee: Rexam Closure Systems Inc., Perrysburg, OH (US)

( * ) Notice: Subject to any disclaimer, the term of this patent is extended or adjusted under 35 U.S.C. 154(b) by 1188 days.

This patent is subject to a terminal disclaimer.

(21) Appl. No.: 10/727,823

(22) Filed: Dec. 3, 2003

(65) Prior Publication Data

US 2005/0121406 A1 Jun. 9, 2005

(51) Int. Cl.
*B65D 55/02* (2006.01)

(52) U.S. Cl. ..... 215/222; 215/332; 215/DIG. 1

(58) Field of Classification Search ..... 215/220–223, 215/331–332, 339, 344, DIG. 1
See application file for complete search history.

(56) References Cited

U.S. PATENT DOCUMENTS

| | | | | |
|---|---|---|---|---|
| 3,297,185 | A | 1/1967 | Plymale | |
| 3,335,923 | A | 8/1967 | Healy | |
| 3,339,770 | A * | 9/1967 | Weigand | 215/214 |
| 3,485,403 | A | 12/1969 | Hedgewick et al. | |
| 3,608,763 | A * | 9/1971 | Smith et al. | 215/217 |
| 3,610,454 | A | 10/1971 | Malick | |
| 3,720,342 | A | 3/1973 | Vercillo | |
| 3,809,276 | A * | 5/1974 | Landen | 215/332 |
| 3,880,313 | A | 4/1975 | Akers | |
| 3,880,314 | A | 4/1975 | Akers | |
| 3,917,096 | A | 11/1975 | Hedgewick | |
| 3,944,102 | A | 3/1976 | Grau | |
| 3,951,289 | A | 4/1976 | Landen | |
| 3,952,899 | A | 4/1976 | Cooke | |
| 3,979,001 | A | 9/1976 | Bogert | |
| 4,032,028 | A | 6/1977 | Reiss et al. | |

(Continued)

FOREIGN PATENT DOCUMENTS

EP 0042603 12/1981

(Continued)

OTHER PUBLICATIONS

U.S. Appl. No. 09/982,249, filed Oct. 16, 2001, Brozell.

*Primary Examiner*—Anthony Stashick
*Assistant Examiner*—James N Smalley
(74) *Attorney, Agent, or Firm*—Reising Ethington PC

(57) ABSTRACT

A child-resistant package includes a container having a finish with an open end, external thread, stop lug projecting radially outwardly from the finish, and a closure having a base wall, a skirt with internal thread for engagement with the thread on the container finish, spring element and pair of internal lugs on the skirt and extending radially inwardly from the skirt. Each pair of internal lugs includes a first lug that cooperates with the stop lug on the container finish to prevent unthreading of the closure from the finish absent pressure on the closure against the spring element to push the first lug beneath the corresponding stop lug on the container finish, and a second lug circumferentially spaced from the first lug that cooperates with the stop lug to prevent over tightening of the closure on the finish.

15 Claims, 8 Drawing Sheets

U.S. PATENT DOCUMENTS

| | | | | | |
|---|---|---|---|---|---|
| 4,053,077 | A | | 10/1977 | DeFelice | |
| 4,084,716 | A | | 4/1978 | Bogert | |
| 4,090,629 | A | | 5/1978 | Hedgewick | |
| 4,091,948 | A | * | 5/1978 | Northup | 215/222 |
| 4,128,184 | A | | 12/1978 | Northup | |
| 4,139,112 | A | | 2/1979 | Cooke | |
| 4,159,779 | A | | 7/1979 | Hedgewick | |
| RE30,625 | E | * | 5/1981 | Akers | 215/211 |
| 4,270,664 | A | | 6/1981 | Buono | |
| 4,346,809 | A | | 8/1982 | Kusz | |
| 4,353,475 | A | | 10/1982 | Kachur et al. | |
| 4,360,113 | A | | 11/1982 | Luker | |
| 4,375,858 | A | * | 3/1983 | Shah et al. | 215/217 |
| 4,387,817 | A | * | 6/1983 | Wiles et al. | 215/217 |
| 4,399,920 | A | * | 8/1983 | Swartzbaugh et al. | 215/211 |
| 4,410,097 | A | | 10/1983 | Kusz | |
| 4,434,903 | A | * | 3/1984 | Cooke | 215/222 |
| 4,523,688 | A | * | 6/1985 | Puresevic et al. | 215/220 |
| 4,553,678 | A | * | 11/1985 | Thorsbakken | 215/218 |
| 4,560,077 | A | | 12/1985 | Dutt | |
| 4,579,238 | A | | 4/1986 | Herr | |
| 4,579,239 | A | | 4/1986 | Hart | |
| 4,598,835 | A | | 7/1986 | Brownbill | |
| 4,620,640 | A | | 11/1986 | Swartzbaugh | |
| 4,627,547 | A | | 12/1986 | Cooke | |
| 4,664,273 | A | | 5/1987 | Simon | |
| 4,669,624 | A | | 6/1987 | Wiles et al. | |
| 4,674,643 | A | | 6/1987 | Wilde et al. | |
| 4,682,700 | A | | 7/1987 | Montgomery et al. | |
| 4,739,890 | A | * | 4/1988 | Cooke | 215/222 |
| 4,823,967 | A | | 4/1989 | Thompson | |
| 5,020,682 | A | | 6/1991 | Dutt | |
| 5,105,960 | A | | 4/1992 | Crisci et al. | |
| 5,133,471 | A | | 7/1992 | Pujol Almirall | |
| 5,135,124 | A | | 8/1992 | Wobser | |
| 5,147,053 | A | | 9/1992 | Friedenthal | |
| 5,161,706 | A | | 11/1992 | Weinstein | |
| 5,186,344 | A | | 2/1993 | Cook | |
| 5,279,434 | A | | 1/1994 | Aguirrezabal | |
| 5,317,796 | A | | 6/1994 | Hunter | |
| 5,449,078 | A | | 9/1995 | Akers | |
| 5,462,186 | A | | 10/1995 | Ladina et al. | |
| 5,687,863 | A | * | 11/1997 | Kusz | 215/216 |
| 5,769,268 | A | | 6/1998 | Kuzma et al. | |
| 5,785,195 | A | | 7/1998 | Zwemer et al. | |
| 5,803,287 | A | | 9/1998 | Kusz | |
| 5,836,466 | A | | 11/1998 | Briere | |
| 5,915,576 | A | * | 6/1999 | Robinson | 215/216 |
| 6,056,143 | A | | 5/2000 | Stolzman | |
| 6,109,466 | A | | 8/2000 | Carrier | |
| 6,152,315 | A | | 11/2000 | Montgomery | |
| 6,327,770 | B1 | | 12/2001 | Konefal et al. | |
| 6,343,705 | B1 | | 2/2002 | Minnette | |
| 6,378,713 | B2 | | 4/2002 | Montgomery | |
| 6,446,823 | B2 | | 9/2002 | Miceli et al. | |
| 6,450,352 | B1 | | 9/2002 | DeJonge | |
| 6,503,373 | B2 | | 1/2003 | Eerden et al. | |
| 6,523,709 | B2 | * | 2/2003 | Miceli et al. | 215/228 |
| 6,983,859 | B2 | * | 1/2006 | Azzarello | 220/288 |
| 2001/0035388 | A1 | | 11/2001 | Miceli | |
| 2002/0062626 | A1 | | 5/2002 | Gregory | |
| 2002/0162817 | A1 | | 11/2002 | Vassallo | |
| 2002/0166834 | A1 | * | 11/2002 | Branson et al. | 215/216 |
| 2002/0195412 | A1 | | 12/2002 | Miceli | |
| 2003/0075519 | A1 | | 4/2003 | Miceli | |
| 2003/0098285 | A1 | | 5/2003 | Gregory | |

FOREIGN PATENT DOCUMENTS

| | | |
|---|---|---|
| EP | 0281284 | 9/1988 |
| EP | 0528561 | 2/1993 |
| EP | 1302406 A3 | 8/2003 |
| GB | 2108095 | 5/1983 |
| GB | 2195620 | 4/1988 |
| GB | 2203136 | 10/1988 |
| GB | 2222821 | 3/1990 |

* cited by examiner

CHILD-RESISTANT CLOSURE, CONTAINER AND PACKAGE

FIELD OF THE INVENTION

The present invention is directed to child-resistant packages, to closures and containers for such packages, and to methods of making such packages, closures and containers.

BACKGROUND OF THE INVENTION

Child-resistant packages are conventionally employed for prescription vials, vitamin bottles, and a number of other applications including containers for caustic or hazardous materials. The present invention pertains particularly to those types of child-resistant packages that involve application of axial pressure and simultaneous turning of the closure with respect to the container in order to remove the closure from the container. The present invention involves a number of features or aspects in a child-resistant closure, container or package, which may be implemented separately from, or more preferably, in combination with each other.

SUMMARY OF THE INVENTION

A child-resistant package includes a container having a finish with an open end, at least one external thread, at least one stop lug projecting radially outwardly from the finish, and a closure having a base wall, a skirt with at least one internal thread for engagement with the thread on the container finish, at least one spring element and at least one pair of internal lugs on the skirt. Each pair of lugs on the skirt includes a first lug that cooperates with the stop lug on the container finish to prevent unthreading of the closure from the finish absent pressure on the closure against the spring element to push the first lug on the skirt beneath the corresponding stop lug on the container finish. Each pair of lugs on the skirt also preferably includes a second lug circumferentially spaced from the first lug that cooperates with the stop lug on the container finish to prevent "over-threading" or over tightening of the closure on the finish. Accordingly, the first lug provides a child-resistant feature requiring the closure to be pressed and turned in order to remove it from the container finish. The second lug provides a thread-stop feature which limits the extent to which the closure can be threaded onto the container finish, to prevent damage to the lugs, threads and spring.

In one exemplary embodiment of a child-resistant package, the stop lug on the container finish and the first lug on the closure skirt have circumferentially extending and axially inclined cam surfaces. During the range of engagement of the first lug with the stop lug as the closure is threaded or rotated onto the container, the closure is increasingly displaced toward the container against the bias of the spring element, until the first lug on the closure passes the stop lug on the container finish whereupon the spring element biases the closure away from the container. Accordingly, in this arrangement, the first lug on the closure skirt slides or cams under the stop lug on the container finish. In another exemplary embodiment of a child-resistant container package, the first lug on the closure skirt has a radially inclined cam surface that engages the stop lug and causes the first lug on the closure skirt to cam radially outwardly over the stop lug on the container finish. In both embodiments, after the first lug on the closure skirt passes the stop lug on the container finish, reverse rotation of the closure is prevented by engagement of the first lug with the stop lug, unless a sufficient axial force is provided on the closure, against the spring element, to move the first lug beneath the stop lug on the container finish.

In another exemplary embodiment of a child-resistant packages a flange is provided on the container finish. The flange is constructed and arranged to overlie the first lug on the container finish when it is rotated past the stop lug as the closure is threaded onto the container. The flange preferably extends from the stop lug and closely overlies the first lug on the closure skirt to inhibit or prevent the closure from being partially axially displaced or cocked relative to the container, to avoid damage to the threads and lugs, and to prevent the closure from being removed from the container without application of the required push and turn forces on the closure.

BRIEF DESCRIPTION OF THE DRAWINGS

These and other objects, features, advantages and aspects of the present invention will be apparent from the following detailed description of the preferred embodiments and best mode, appended claims and accompanying drawings in which:

DETAILED DESCRIPTION OF THE PREFERRED EMBODIMENTS

Referring in more detail to the drawings, FIGS. 1 and 3-5 illustrate a child-resistant package 30 that includes a container 32 and a closure 34 received on the container 32. When the closure 34 is fully received on the container 32, interfering lugs on both the closure 34 and the container 32 prevent the closure 34 from being simply rotated off of a container finish 36. Rather, to remove the closure 34 from the container 32, the closure 34 must be pushed down until lugs on the closure 34 clear lugs on the container 32 so that the closure 34 may be rotated relative to the container 32. Preferably, the lugs on the closure 34 and container 32 also interfere axially to prevent the closure 34 from being cocked or partially removed without rotating the closure relative to the container 32. (Directional words such as "down" are employed by way of description and not limitation with respect to the upright orientation of the package illustrated, for example, in FIGS. 1-2 and 4-6. Directional words such as "axial" likewise are employed by way of description and not limitation with respect to the axis of the container finish or the closure skirt, as applicable.)

Figure 2:
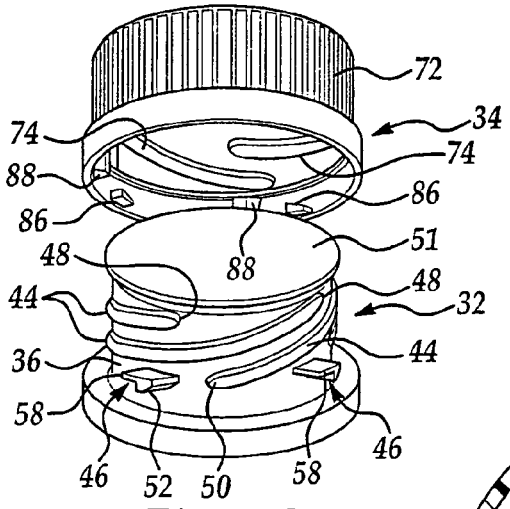
FIG. 2 is a fragmentary perspective view illustrating a closure and container finish of the package shown in FIG. 1.
Figure 3:
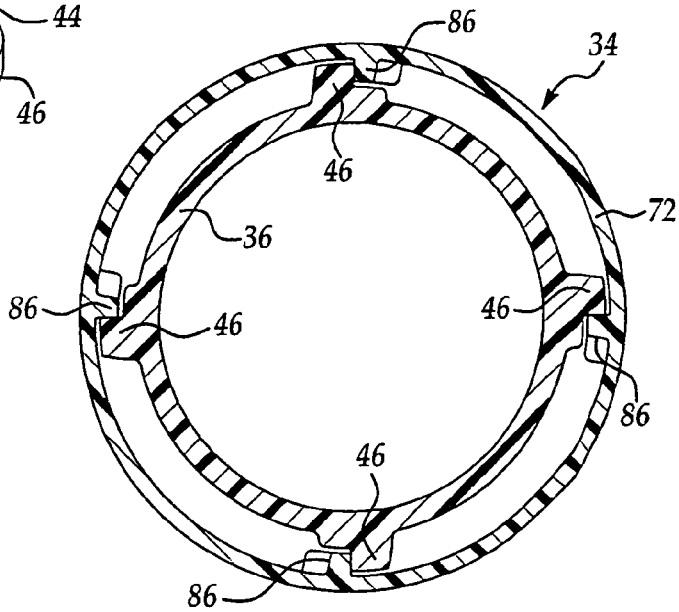
FIG. 3 is a cross-sectional view taken generally along line 3-3 in FIG. 1.

The container 32 includes a body 40 defining an interior volume in which a product is stored, and a generally cylindrical finish 36 with an open end 42. On the finish 36 are provided at least one external thread 44 and at least one stop lug 46 separate from the thread 44 and projecting radially outwardly from the finish 36. As shown in FIG. 2, a plurality of external thread or thread segments 44 may be provided on the finish 36, and the embodiment shown has four separate threads 44. Each thread 44 has one end 48 adjacent to the open end 42 of the finish 36, extends partially around the circumference of the finish 36 and is inclined axially so that a second end 50 is spaced from the open end 42 of the container finish 36. Likewise, a plurality of stop lugs 46 may be provided on the container finish 36, and in the preferred embodiment, four separate stop lugs 46 are provided all preferably evenly circumferentially spaced and axially located on the finish 36. If desired, a liner 51, tamper resistant seal, or a freshness seal may be disposed over the open end 42 of the finish 36, as shown in FIG. 2.

Figure 4:
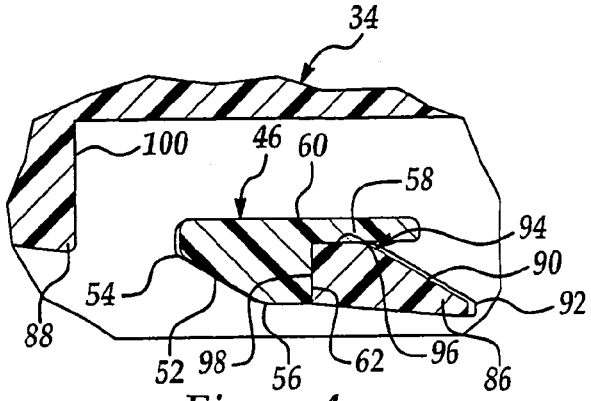
FIG. 4 is a fragmentary sectional view illustrating engagement of a first lug on a closure skirt with a stop lug on the container finish of the package shown in FIG. 1.
Figure 5:
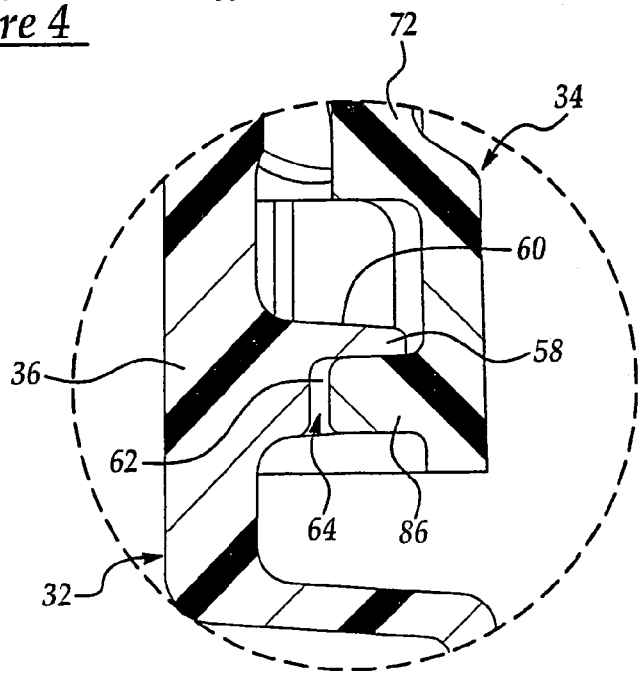
FIG. 5 is an enlarged fragmentary view of the encircled portion 5 in FIG. 1.
Figure 6:
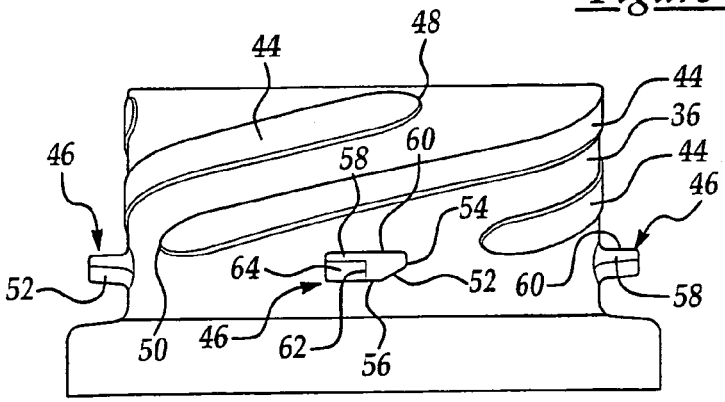
FIG. 6 is an elevational view of a finish of a container for the child-resistant package shown in FIG. 1.
Figure 7:
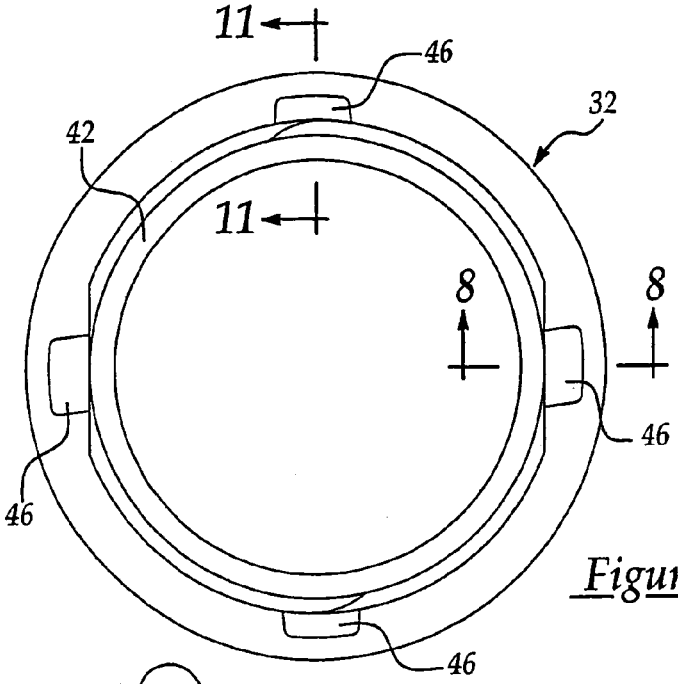
FIG. 7 is a plan view of the finish shown in FIG. 6.
Figure 8:
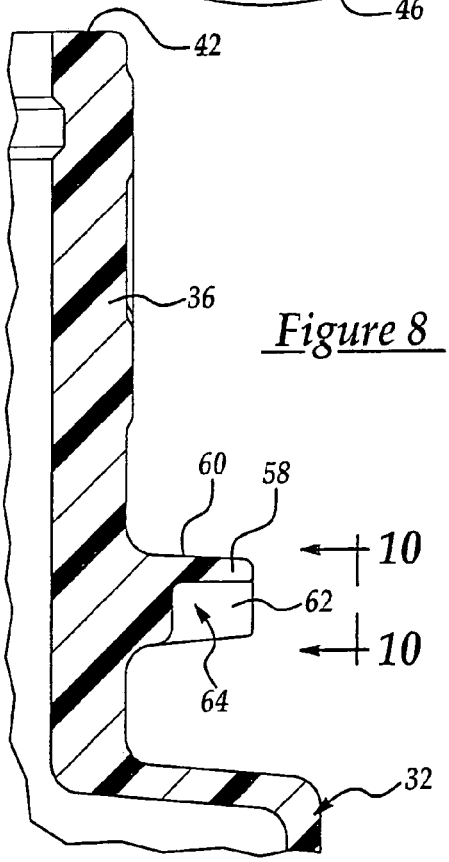
FIG. 8 is a fragmentary sectional view taken along line 8-8 in FIG. 7.
Figure 9:
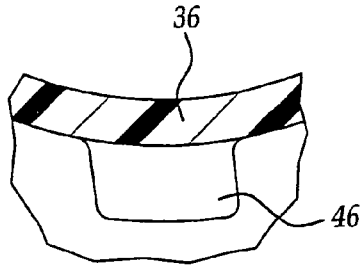
FIG. 9 is a fragmentary sectional view of the stop lug on the container finish.
Figure 10:
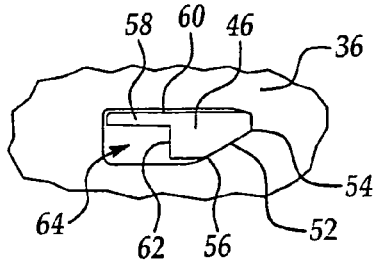
FIG. 10 is a fragmentary elevational view in the direction of the arrows 10 in FIG. 8.
Figure 11:
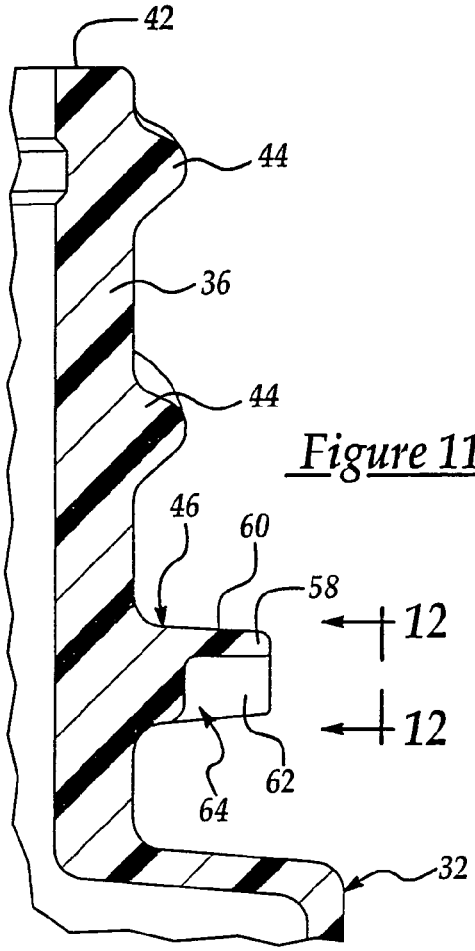
FIG. 11 is a fragmentary sectional view taken along line 11-11 in FIG. 7.
Figure 12:
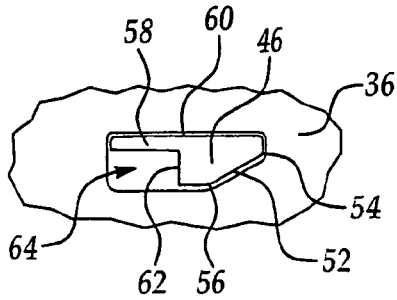
FIG. 12 is a fragmentary elevational view in the direction of the arrows 12 in FIG. 11.
Figure 13:
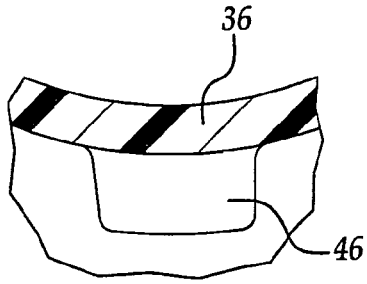
FIG. 13 is a fragmentary sectional view of a stop lug on the container finish.

In the preferred embodiment, each stop lug 46 is preferably located adjacent to but circumferentially spaced from a second end 50 of a separate one of the threads 44. As best shown in FIGS. 4 and 6, each stop lug 46 preferably includes a cam surface 52 that engages and permits a corresponding lug on the closure 34 to pass by the stop lug 46 as the closure 34 is rotated clockwise to thread it on the container finish 36. In the preferred embodiment, the cam surface 52 of each stop lug 46 preferably extends circumferentially from a first end 54 to a second end 56, and radially outwardly from the container finish 36. Each cam surface 52 is inclined axially from its first end 54 to its second end 56, with the second end 56 being spaced circumferentially from and axially further away from the open end 42 of the container finish 36 then the first end 54. In the preferred embodiment, each stop lug 46 preferably also includes a circumferentially extending flange 58 spaced clockwise from the cam surface 52. Preferably, the flange 58 is continuous with the remainder of the stop lug 46 and provides a generally planar upper surface 60 of the stop lug 46 that is generally perpendicular to the axis of the finish 36. Together with an axially extending surface 62 of the stop lug 46 that is spaced immediately clockwise from the cam surface 52, the flange 58 defines a pocket 64 spaced immediately clockwise from the cam surface 52. As shown, the pocket 64 is open circumferentially in a clockwise direction and axially away from the open end 42 of the finish 36.

Figure 1:
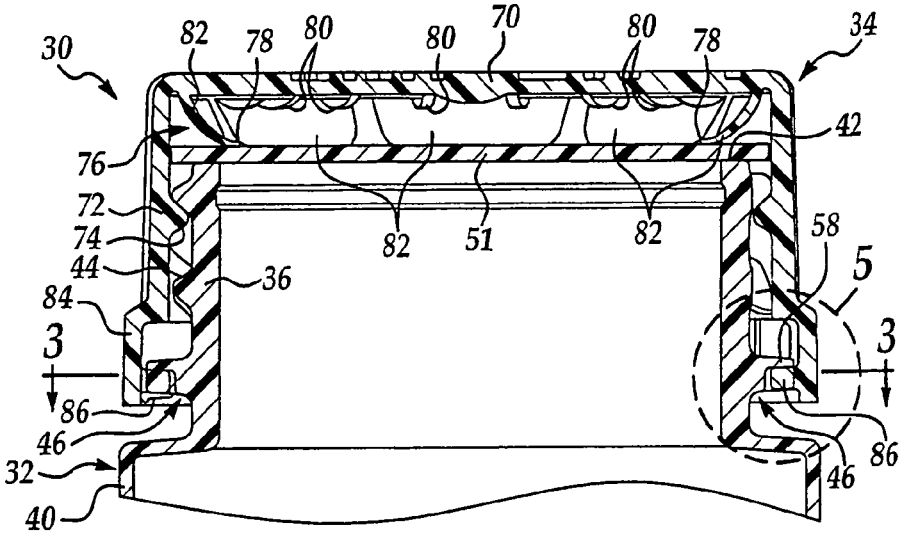
FIG. 1 is a fragmentary cross-sectional view of one presently preferred embodiment of a child-resistant package.
Figure 14:
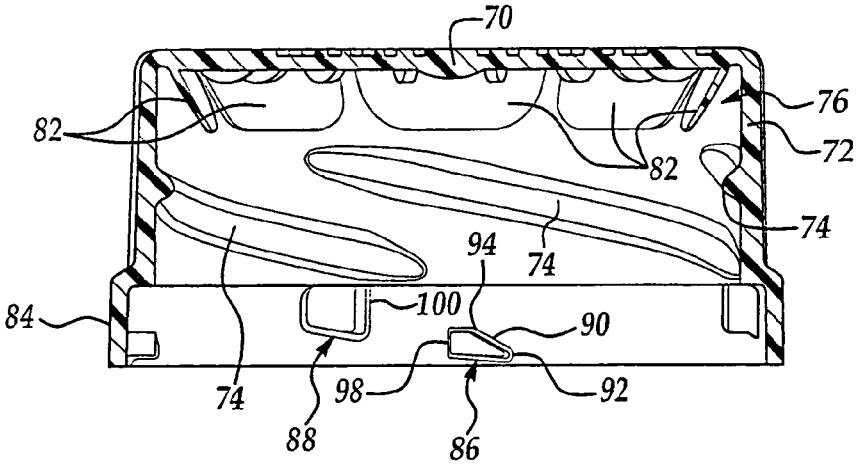
FIG. 14 is a cross-sectional view of the closure of the package shown in FIG. 1.
Figure 15:
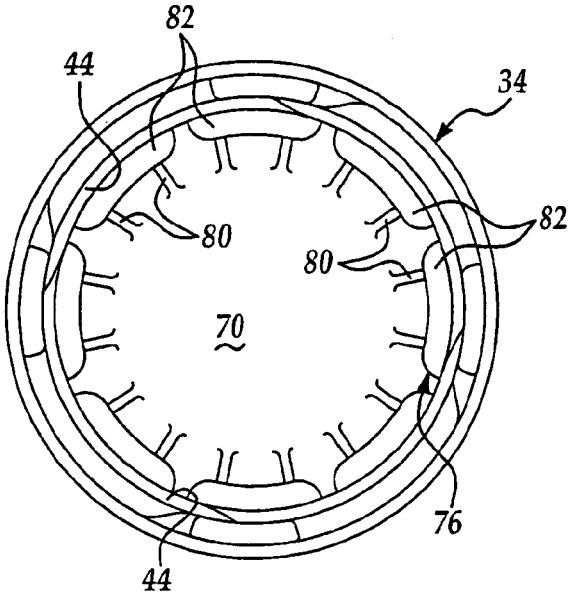
FIG. 15 is a bottom view showing the interior of the closure.
Figure 16:
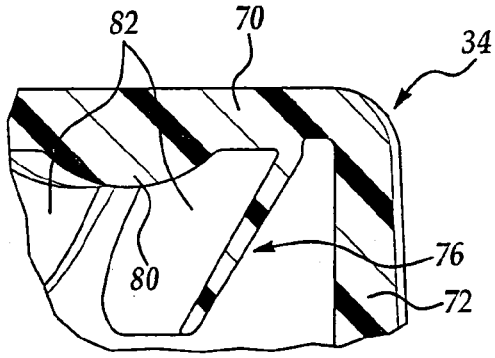
FIG. 16 is an enlarged fragmentary sectional view illustrating a spring element and spring stop of the closure.
Figure 17:
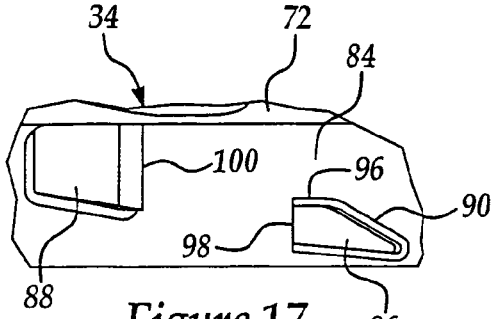
FIG. 17 is a fragmentary elevational view illustrating one pair of first and second lugs on the closure skirt.
Figure 18:
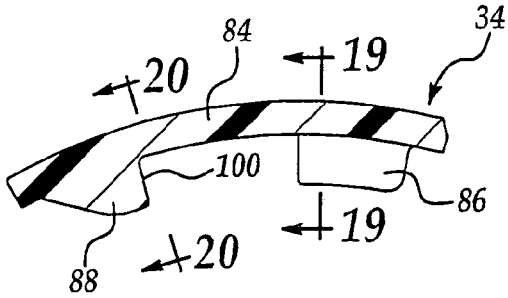
FIG. 18 is a fragmentary sectional view illustrating one pair of first and second lugs on the closure skirt.
Figure 19:
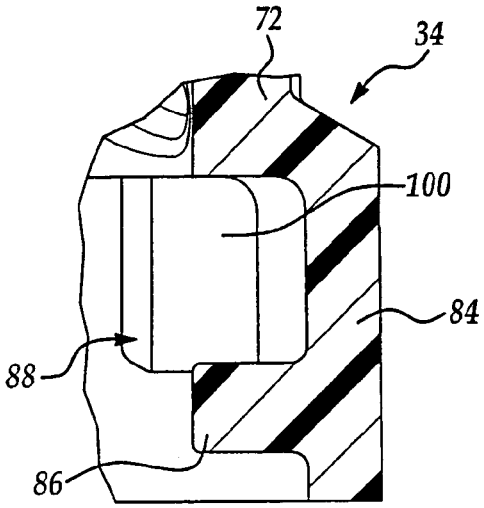
FIG. 19 is a fragmentary sectional view taken along line 19-19 in FIG. 18.
Figure 20:
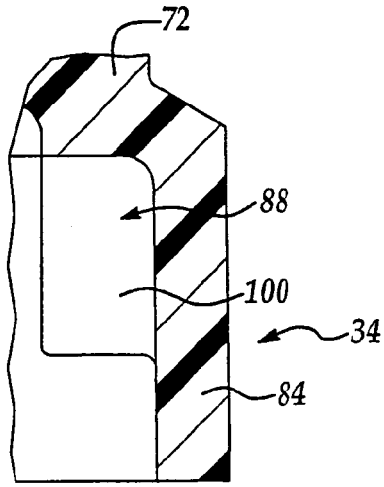
FIG. 20 is a fragmentary sectional view taken along line 20-20 in FIG. 18.

As best shown in FIGS. 1, 14 and 15 the closure 34 has a base wall 70 adapted to overlie the open end 42 of the finish 36 and a peripheral, annular skirt 72 extending from the base wall 70 and having at least one internal thread 74 for engagement with the external threads 44 on the finish 36. Preferably, the closure 34 has the same number of threads or thread segments 74 as the container 32, and is shown in the preferred embodiment as having four separate threads 74, like the container. The closure is so constructed and arranged that, when received on the container, the base wall 70 of the closure 34 generally overlies the open end 42 of the finish 36 and the skirt 72 is threadably engaged with and circumferentially surrounds at least a portion of the finish 36.

Figure 27:
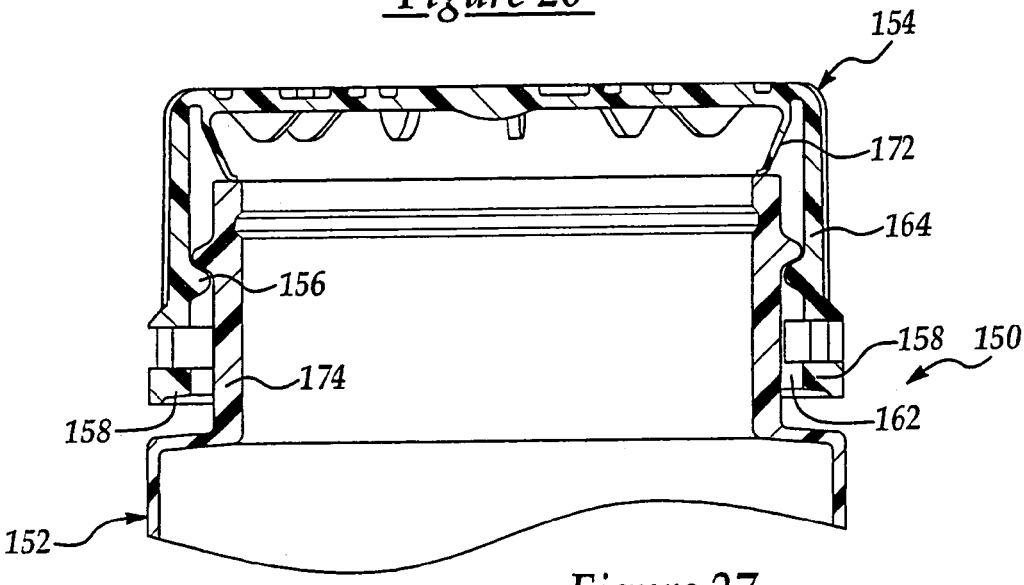
FIG. 27 is a fragmentary sectional view of the alternate embodiment package illustrating the closure shown in FIG. 26 threaded on a container finish.

Carried by and preferably attached to one or both of the base wall 70 and the skirt 72 is at least one spring element 76 that yieldably axially biases the closure 34 in a direction moving the base wall 70 away from the finish 36. The spring element 76 is preferably integrally formed as a single component with the closure 34 that extends axially away from the base wall 70 and radially inwardly terminating at a free edge 78 so that the spring element 76 is flexible and resilient. Each spring element 76, which are identical, preferably tapers in thickness toward the free edge of the spring element to provide differential flexing of the spring element. That is, the free edge of the spring element initially will flex as shown in FIG. 1, and the mid and base portions of the spring element will only begin to flex after substantial flexing of the free edge. The free edge 78 of the spring element 76 is adapted to engage either the end of the container finish 36 (as shown in the embodiment of FIG. 27), or a liner 51 (as shown in the embodiment of FIG. 1) which may be carried by the closure 34 and adapted to provide a seal of the open end of the finish 36 when the closure 34 is fully received on the container 32.

To prevent over-flexing or plastic deformation of the spring element 76, circumferentially spaced and axially extending spring stops 80 are preferably provided on the base wall 70 of the closure 34 to limit the flexing or axial displacement of the spring element 76. In the preferred embodiment, as best shown in FIGS. 1, 14 and 15, the spring element 76 preferably includes a plurality of circumferentially spaced spring segments 82, and one or more spring stops 80 are preferably provided for each spring segment 82. In the preferred embodiment, eight separate spring segments 82 are provided, although any number of spring segments 82 including one annular and continuous spring segment may be used.

Adjacent its axially lower end, the skirt 72 may include a radially outwardly extending portion 84 providing a larger inner diameter than in the remainder of the skirt 72. The larger inner diameter may be provided to accommodate a plurality of lugs on the closure 34 which cooperate with the stop lugs 46 on the container finish 36 as set forth in more detail below. The skirt 72 has a stepped profile that includes a first portion on which the at least one thread 74 is disposed, and the radially outwardly extending portion, or second portion, 84 being connected to the first portion by inner and outer shoulders. The second portion 84 terminates at an open end of the skirt opposite of the base wall 70 and is stepped to extend radially outwardly from the first portion. The second portion 84 includes an outer diameter larger than that of the first portion, and an inner diameter larger than that of the first portion.

In the preferred embodiment of the package 30, the closure 34 includes at least one pair of internal lugs 86, 88 extending radially inwardly from the skirt 72. More specifically, the lugs 86, 88 are disposed on the second portion 84 of the skirt 72, and include a first lug 86 positioned proximate and just axially above the open end of the skirt, and a second lug 88 circumferentially spaced from the first lug 86 and positioned proximate and just axially below the inner shoulder of the closure skirt 72. As best shown in FIGS. 2, 3, 14, 17 and 21-24, the closure 34 preferably includes several pairs of internal lugs 86, 88, and in the preferred embodiment has four such pairs of internal lugs, with each pair associated with a separate one of the stop lugs 46 on the container finish 36. Each pair of internal lugs 86, 88 on the closure skirt 72 includes a first lug 86 that cooperates with a respective stop lug 46 on the container finish 36 to prevent unthreading of the closure 34 from the finish 36 when the closure 34 is simply rotated relative to the finish 36. A second lug 88 of each internal pair of lugs is circumferentially spaced from its associated first lug 86 and cooperates with the stop lug 46 on the container finish 36 to prevent over-tightening or further threading of the closure 34 onto the finish 36 after the closure 34 is fully received on the finish 36.

As shown in FIGS. 4, 14, 17-19, 21 and 23-25, the first lug 88 of each pair of internal lugs on the closure skirt 72 includes a cam surface 90 which extends radially inwardly from the skirt 72 and circumferentially from a first end 92 to a second end 94. The cam surface 90 is also preferably inclined axially with its first end 92 being further away from the base wall 70 than its second end 94. A generally planar and circumferentially extending upper surface 96 of the first lug 86 is spaced clockwise from the cam surface 90, and in the preferred embodiment, terminates at an axially extending stop surface 98 of the first lug 86. The upper surface 96 of the first lug 86 is preferably generally perpendicular to the axis of the skirt 72 and container finish 36.

As shown in FIGS. 4, 14, 17, 18, 20 and 22, the second lug 88 of each pair of internal lugs on the closure skirt 72 preferably includes an axially extending stop surface 100 that is generally opposed to and faces in the opposite direction of the stop surface 98 of its associated first lug 86. The stop surface 100 of the second lug 88 is circumferentially spaced clockwise from the stop surface 98 of the first lug 86. The second lug 88 preferably has at least a portion that extends axially below the upper surface 96 of the first lug 86, and may extend axially above the upper surface 96 of the first lug 86. On the opposite side of the stop surface 100, the second lug 88 may taper until its blends with the skirt 72.

Figure 21:
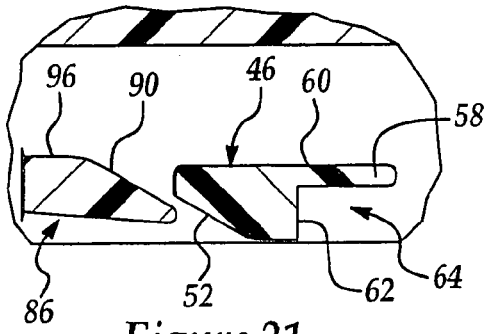
FIG. 21 is a fragmentary sectional view illustrating a stop lug on the container finish and a first lug on the closure skirt prior to their engagement as the closure is threaded onto the finish.
Figure 22:
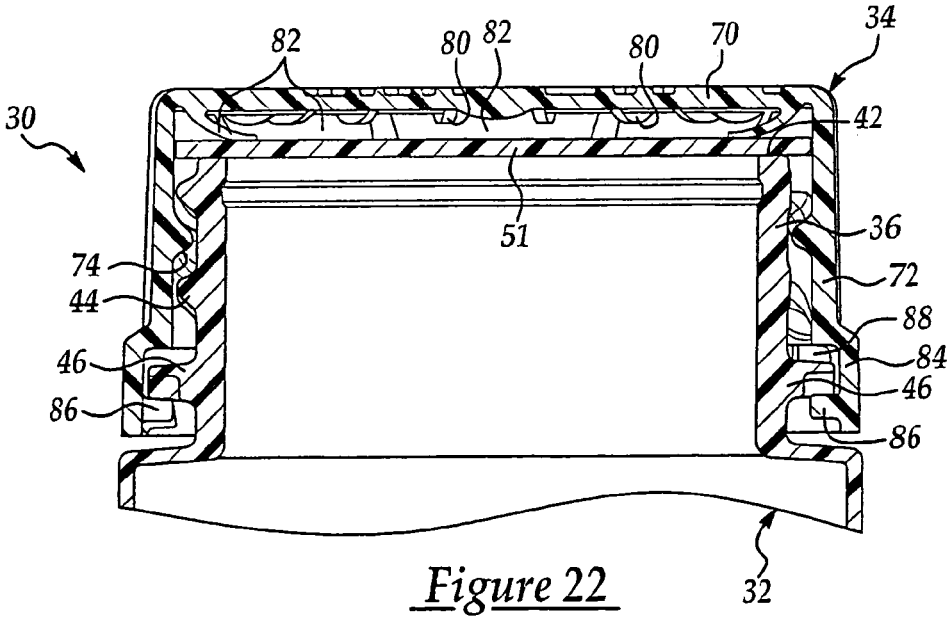
FIG. 22 is a cross-sectional view illustrating a closure threaded onto the container finish with the first lugs on the closure skirt camming under the stop lugs on the container finish as the closure is threaded onto the container finish.
Figure 23:
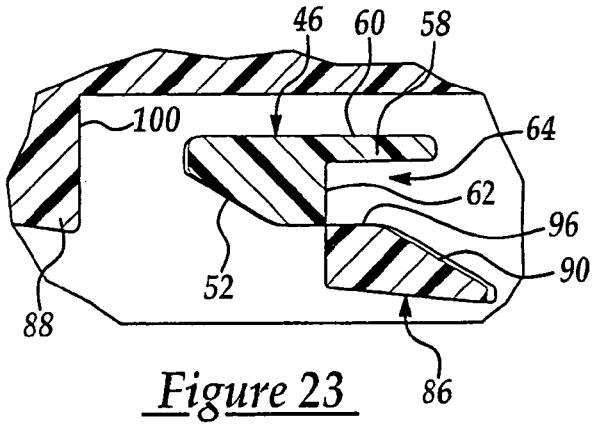
FIG. 23 is a fragmentary sectional view illustrating a first lug on the closure skirt as it is cammed under a stop lug on the container finish.

To put the closure 34 on the container 32, the closure skirt 72 is aligned with and disposed over a portion of the container finish 36. The closure 34 is then rotated clockwise with the internal threads 74 on the closure skirt 72 engaging the external threads 44 on the container finish 36 to axially advance the closure 34 on the finish 36. Rotation of the closure 34 continues until, as shown in FIG. 21, the first lugs 86 on the closure skirt 72 approach their associated stop lugs 46 on the container finish 36, with the first lug 86 and stop lug 46 being generally axially aligned such that further rotation will engage the cam surfaces 90, 52 of the lugs 86, 46, respectively. Further rotation of the closure 34 engages the cam surfaces 90, 52 together and as shown in FIGS. 22 and 23, causes a corresponding axial displacement of the closure 34 further onto the container finish 36 with the first lug 86 of each pair of internal lugs on the closure skirt 72 sliding or camming under their associated stop lugs 46 on the container finish 36. As shown in FIG. 22, the camming of the first lugs 86 on the closure skirt 72 under the stop lugs 46 on the container finish 36 displaces the spring segments 82 of the spring element 76 providing a force on the closure 34 tending to move it away from the container finish 36. Further rotation of the closure 34 relative to the container 32 moves the first lug 86 passed the stop lugs 46 and the force of the spring element 76 biases the closure 34 away from the container 32.

Figure 24:
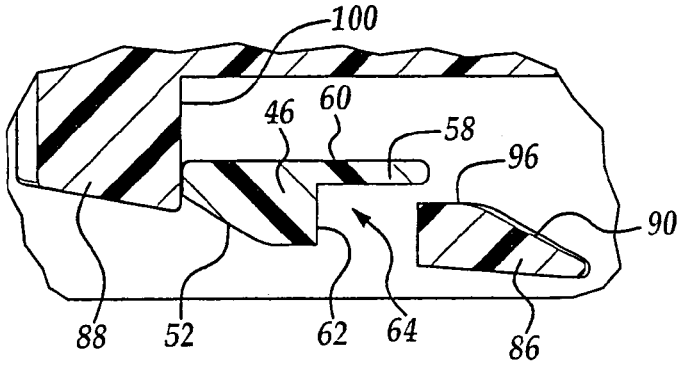
FIG. 24 is a fragmentary sectional view illustrating a stop lug on the container finish engaging a second lug on the closure skirt to prevent over threading of the closure on the container finish.
Figure 25:
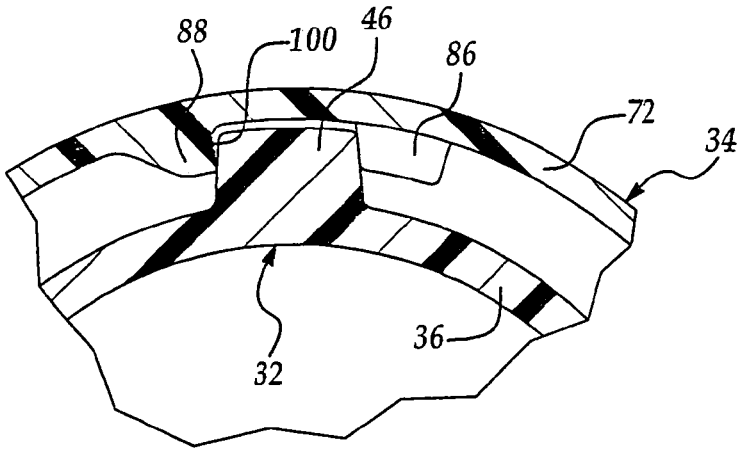
FIG. 25 is a fragmentary sectional view illustrating a stop lug on the container finish engaged with a second lug on the closure as in FIG. 24.

As shown in FIGS. 1 and 3-5, this disposes the first lug 86 on the closure skirt 72 in the pocket 64 of a corresponding stop lug 46 with the upper surface 96 of the first lug 86 adjacent to and preferably engaged with the flange 58 of the stop lug 46. As shown in FIGS. 24 and 25, continued rotation of the closure 34 clockwise relative to the container 32 engages the stop surface 100 of at least one second lug 88 on the closure skirt 72 with a stop lug 46 on the container finish 36 to prevent further rotation of and over-tightening the closure 34 on the container finish 36. Desirably, the circumferential distance between the first lug 86 and second lug 88 in each pair of internal lugs on the closure skirt 72 is less than the circumferential dimension of the stop lug 46 so that at least a portion of each first lug 86 remains axially beneath the flange 58 of its associated stop lug 46 even when the stop lugs 46 are engaged with their associated second lugs 88.

With the closure 34 fully received on the container 32, simple counterclockwise rotation of the closure 34 will engage the stop surface 98 of the first lug 86 with the axial surface 62 of the stop lug 46 that defines in part the pocket 64 thus preventing further counterclockwise rotation of the closure 34 as best shown in FIG. 4. Similarly, attempts to pry the closure 34 or a portion of the closure 34 axially relative to the container finish 36 will engage the upper surface 96 of the first lug 86 with the flange 58 of the stop lug 46 to at least substantially inhibit and preferably prevent the closure 34 from being pried off the container 32 or axially cocked sufficiently to disengage the stop lug 46 and first lug 86. Desirably, preventing the closure 34 from being cocked relative to the container finish 36 prevents damage to the lugs 46, 86, 88 and threads 44, 74 that can be caused by forcibly prying the closure 34 from the finish 36.

Since simple counterclockwise rotation of the closure 34 to remove it from the container finish 36 is prevented by engagement of the first lug 86 and the stop lug 46, the closure 34 must be displaced axially downwardly against the force of the spring element 76 a sufficient distance so that the first lugs 86 are axially beneath and clear of the stop lug 46 on the container finish 36. Then, the closure 34 can be rotated counterclockwise passing the first lugs 86 beneath their associated stop lugs 46 and backing the closure 34 off of the container finish 36 through action of the cooperating threads 44, 74 on the finish 36 and skirt 72.

Desirably, the axially inclined cam surfaces 52, 90 of both the stop lugs 46 and the first lugs 86 displace or flex the spring element 76 as the first lugs 86 cam beneath the stop lugs 46, and do not cause any distortion of the container finish 36 or closure skirt 72 due to the forces required to slide the cam surfaces 52, 90 relative to each other. And to prevent damage to the spring element 76 or individual spring segments 82 of the spring element 76, the spring stops 80 limit the extent to which each spring segment 82 can be displaced or flexed.

Figure 26:
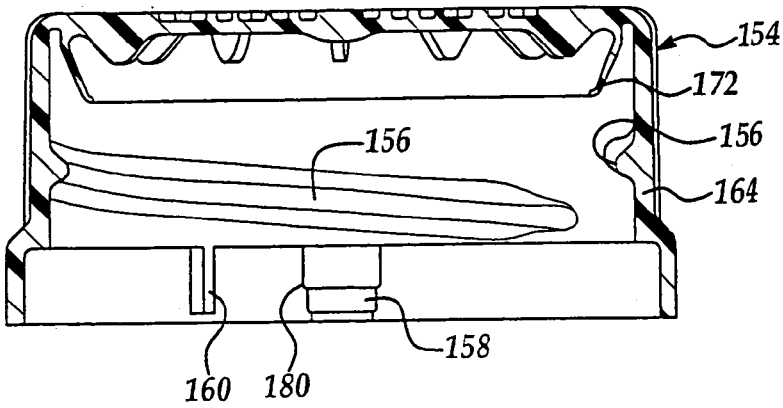
FIG. 26 is a sectional view of a closure for an alternate embodiment child-resistant package.
Figure 28:
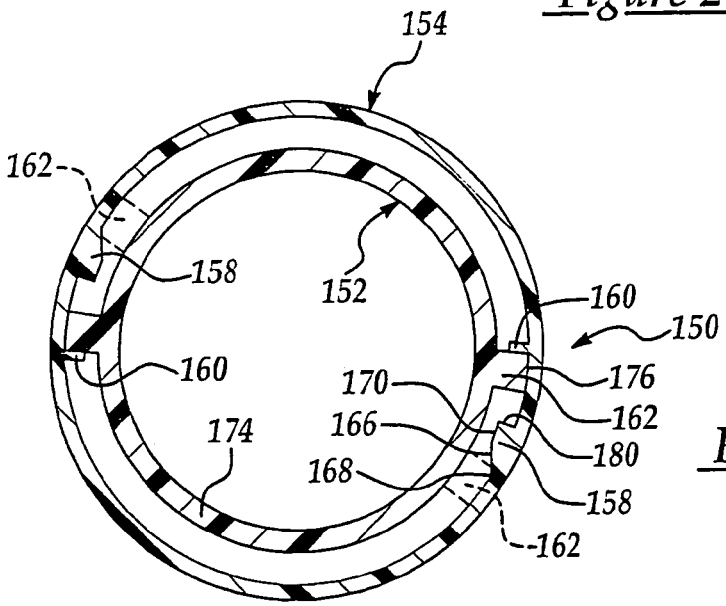
FIG. 28 is a sectional view through the container finish and closure skirt of the package of FIGS. 26 and 27.

FIGS. 26-28 illustrate an alternate embodiment child-resistant package 150 including a modified container 152 and a modified closure 154. As shown in FIG. 26, the closure 154 may have a pair of internal threads 156 and two sets of first and second internal lugs 158, 160, respectively. As shown in FIG. 28, each second lug 160 may be generally flat and extend radially inwardly to contact a corresponding stop lug 162 on the container 152 and prevent over-tightening of the closure 154 on the container 152 as in the first embodiment package 30. Each first lug 158 extends radially outwardly from the closure skirt 164, extends circumferentially, and has a cam surface 166 (FIG. 28) that is radially inclined from a first and 168 to a second end 170 of the cam surface 166. The second end 170 of the cam surface 166 is disposed radially inwardly of and is circumferentially spaced clockwise from the first end 168. As shown in FIGS. 26 and 27, the spring element 172 may be continuous, generally frustoconical and integral with the closure 154. Other spring elements including, for example, those having more than one spring element, or a spring element having multiple segments can be used.

Each stop lug 162 on the container finish 174, as best shown in FIG. 28, may extend radially outwardly from and circumferentially along the finish 174. A cam surface 176 of each stop lug 162 may be defined by a generally circumferentially and axially extending peripheral face of the stop lug 162. In the embodiment shown, the cam surface 176 of each stop lug 162 is not inclined radially or axially, although it could be inclined or otherwise formed as desired.

As shown in FIG. 28, as the closure 154 is rotated clockwise on the finish 174, each first lug 158 will engage a corresponding stop lug 162 (as shown in phantom in FIG. 28) prior to the closure 154 being fully received on the finish 174. Continued rotation of the closure 154 will cause the first lugs 158 to cam radially over and eventually pass their associated stop lugs 162. The radial camming of the first lugs 158 temporarily deforms the closure skirt 164 which is somewhat flexible and resilient so it is not damaged in use. Further clockwise rotation of the closure 154 is limited by engagement of the stop lugs 162 with associated second lugs 160 on the closure 154 as shown in FIG. 28. Counterclockwise rotation of the closure 154 without application of an axial force to the closure will engage a stop surface 180 on each first lug 158 with the stop lugs 162 on the finish 174. To remove the closure 154, sufficient axial force must be applied to the closure 154 to move the first lugs 158 axially beneath the stop lugs 162 and then the closure 154 must be rotated counterclockwise. In other words, the closure 154 must be pushed down and turned.

There have thus been disclosed a child-resistant package, a closure, a container, and a method of making a child-resistant package. Two presently preferred embodiments of the invention have been disclosed, and a number of modifications and variations have been discussed. Those skilled in the art will readily recognize that the description of the presently preferred embodiments and the suggested modifications and variations have been set forth in terms of description, and not limitation. Other embodiments, modifications and variations will readily suggest themselves to persons of ordinary skill in the art. The invention is intended to embrace all such embodiments, modifications and variations that fall within the sprit and broad scope of the appended claims. Further, descriptive adjectives used in the specification, such as for example, beneath, above, clockwise, counterclockwise and the like, are used with reference to the package, closure and container as shown in the accompanying drawings, and generally provide the container in an upright position with the closure positioned on and over the open end of the container finish.

The invention claimed is:

1. A child-resistant package that includes:

a container having a cylindrical finish with an open end, at least one external thread including a first end adjacent to said open end and a second end spaced from said open end, and at least one external lug separate from said at least one external thread and projecting radially outwardly from said finish adjacent to and circumferentially spaced from said second end of said thread remote from said open end, and a closure having a base wall, a skirt with at least one internal thread for engagement with said at least one external thread on said finish, at least one pair of internal lugs on said skirt adjacent to an end of said internal thread remote from said base wall, and at least one spring element for engaging said open end of said finish to bias said closure axially of said finish, said at least one external lug on said container finish having an axially oriented cam face that slopes in a clockwise direction away from said open end, said at least one pair of internal lugs on said closure skirt having a first lug with an axially oriented cam face that slopes toward said base wall such that threading said closure onto said finish in a clockwise direction causes said first lug on said skirt to cam axially away from said open end relative to said at least one external lug on said finish by compression of said at least one spring element, said at least one pair of internal lugs also having a second lug that engages said at least one external lug on said container finish when said closure is fully received on said container finish to limit clockwise rotation of said closure relative to said container finish, wherein said closure skirt has a stepped profile that includes a first portion on which said at least one internal thread is disposed and a second portion being connected to said first portion by inner and outer shoulders of said closure skirt and terminating at a skirt open end opposite of said base wall and being stepped to extend radially outwardly from said first portion and having an outer diameter larger than that of said first portion and having an inner diameter larger than that of said first portion on which said at least one pair of internal lugs is disposed, and said first lug is positioned proximate and just axially above said skirt open end and said second lug is positioned proximate and just axially below said inner shoulder of said closure skirt.

2. The package of claim 1 wherein said at least one external lug on said container finish includes a clockwise extending flange, and said flange includes a generally planar surface facing away from said open end, and said first lug on said skirt has a complementarily oriented surface adapted to be received closely adjacent to said generally planar surface of said flange to inhibit axial displacement of said first lug on said skirt in a direction toward said open end of said container finish.

3. A closure for a child-resistant package, including:

a base wall, a skirt with at least one internal thread adapted for engagement with at least one external thread on a container finish, at least one pair of internal lugs on said skirt spaced from said at least one internal thread and extending radially inwardly from said skirt, and at least one spring element carried by one of said base wall or said skirt, said at least one pair of internal lugs on said skirt including a first lug for cooperating with a stop lug on the container finish to prevent unthreading of said closure from the container finish absent pressure on said closure against said spring element to push said first lug on said skirt beneath the stop lug on the container finish, and a second lug circumferentially spaced from said first lug for cooperating with the stop lug on the container finish to limit the threading of said closure onto the container finish, wherein said closure skirt has a stepped profile that includes a first portion on which said at least one internal thread is disposed and a second portion being connected to said first portion by inner and outer shoulders of said closure skirt and terminating at a skirt open end opposite of said base wall and being stepped to extend radially outwardly from said first portion and having an outer diameter larger than that of said first portion and having an inner diameter larger than that of said first portion on which said internal lugs are disposed, and said first lug being positioned proximate and just axially above said skirt open end and said second lug being positioned proximate and just axially below said inner shoulder of said closure skirt, and wherein said first lug includes an axially oriented cam face that slopes toward said base wall such that threading said closure onto the container finish causes said first lug on said closure skirt to cam axially away from an open end of the container finish relative to the stop lug on the container finish by compression of the spring element.

4. The closure of claim 3 wherein the first lug has a stop surface facing one direction and the second lug has a stop surface facing generally in the opposite direction of said one direction so that the stop lug limits rotation of the closure in opposite directions.

5. The closure of claim 4 wherein the stop surface of the first lug faces counterclockwise and the stop surface of the second lug faces clockwise.

6. The closure of claim 3 wherein said cam face extends circumferentially and is inclined axially.

7. The closure of claim 3 wherein said cam face extends circumferentially and is inclined radially.

8. The closure of claim 3 wherein said at least one spring element includes a plurality of circumferentially spaced spring segments, each spring segment being cantilevered to at least one of the base wall and the skirt and having a free end that is flexible and resilient.

9. A child-resistant package that includes:

a container having a cylindrical finish with an open end, at least one external thread including a first end adjacent to said open end and a second end spaced from said open end, and at least one external lug separate from said external thread and disposed on a side of said external thread opposite said open end and circumferentially spaced from said second end of said external thread, and a closure having a base wall, and a skirt having a stepped profile that includes a first portion with at least one internal thread for engaging said at least one external thread on said finish and a second portion being connected to said first portion by inner and outer shoulders of said closure skirt and terminating at a skirt open end opposite of said base wall and being stepped to extend radially outwardly from said first portion and having an outer diameter larger than that of said first portion and having an inner diameter larger than that of said first portion, a spring element for urging said closure away from said finish, and at least one pair of internal lugs separate from said internal thread, said at least one pair of internal lugs on said skirt being carried on said second portion adjacent to but circumferentially spaced from each other, and being comprised of a trailing internal lug and a leading internal lug disposed clockwise of said trailing internal lug as viewed from above said package, said leading internal lug being positioned proximate and just axially above said skirt open end and said trailing internal lug being positioned proximate and just axially below said inner shoulder, there being one pair of internal lugs on said skirt for each external lug on said finish, said leading internal lug having an axially oriented cam face sloping toward said base wall such that threading said closure onto the container finish causes said leading internal lug on said closure skirt to cam axially away from the open end of the container finish relative to said external lug on said container finish by compression of the spring element such that said leading internal lug cams over said external lug as said closure is threaded onto said finish against a force supplied by said spring element to said finish until said external lug on said finish is received between said at least one pair of internal lugs on said skirt and said trailing internal lug on said skirt engages said external lug to prevent further threading of said closure onto said finish, removal of said closure from said finish requiring urging said closure onto said finish against the force of said spring element until said leading internal lug on said skirt is disposed beneath said external lug and permits unthreading of said closure from said finish, wherein said external lug on said finish has a cam face that is inclined away from said open end for engagement by said cam face of said leading internal lug on said skirt to pull said closure against said spring element as said closure is threaded onto said finish and said leading internal lug is cammed over said external lug, and wherein said external lug includes a body and a flange circumferentially extending from said body away from said cam surface and disposed so that said leading internal lug on said skirt will be received in a pocket formed between said body and said flange.

10. The package set forth in claim 9 wherein said spring element and said closure are of one-piece integrally molded plastic construction.

11. The package set forth in claim 10 wherein said spring element is a circumferentially segmented annular spring element.

12. The package set forth in claim 9 wherein spacing between said leading and trailing internal lugs is insufficient to permit passage of said external lug between said internal lugs.

13. A child-resistant package that includes:

a container having a cylindrical finish with an open end, at least one external thread, and at least one external lug separate from said external thread and disposed on a side of said external thread opposite said open end, and a closure having a skirt with at least one internal thread for engaging said at least one external thread on said finish, a spring element for urging said closure away from said finish, and at least one pair of internal lugs separate from said internal thread, said pair of internal lugs on said skirt being adjacent to but circumferentially spaced from each other, and being comprised of a trailing internal lug and a leading internal lug disposed clockwise of said trailing internal lug as viewed from above said package, there being one pair of internal lugs on said skirt for each external lug on said finish, said leading internal lug having a cam face for camming said leading internal lug over said external lug as said closure is threaded onto said finish against a force supplied by said spring element to said finish until said external lug on said finish is received between said internal lugs on said skirt and said trailing internal lug on said skirt engages said external lug to prevent further threading of said closure onto said finish, removal of said closure from said finish requiring urging said closure onto said finish against the force of said spring element until said leading internal lug on said skirt is disposed beneath said external lug and permits unthreading of said closure from said finish, wherein said external lug extends radially outwardly from said cylindrical finish of said container and includes a cam surface defined by a generally circumferentially and axially extending peripheral face, wherein as said closure is rotated clockwise onto said finish of said container, said leading internal lug engages said external lug prior to said closure being fully received on said finish, such that engagement of said cam face with said cam surface of said external lug circumferentially stretches said closure skirt, and continued rotation of said closure causes said leading internal lug to cam radially over said external lug, and further rotation of said closure is limited by engagement of said external lug with said trailing internal lug, wherein counterclockwise rotation of said closure absent application of an axial force to said closure results in engagement of said leading internal lug with said external lug, and removal of said closure from said container includes application of axial force to said closure to move said leading internal lug axially beneath said external lug to allow said closure to be rotated counterclockwise.

14. A child-resistant package that includes:

a container having a cylindrical finish with an open end, at least one external thread including a first end adjacent to said open end and a second end spaced from said open end, and at least one external lug separate from said external thread and disposed on a side of said external thread opposite said open end and being circumferentially spaced from said second end of said external thread, and a closure having a base wall, and a skirt having a stepped profile including a first portion with at least one internal thread for engaging said at least one external thread on said finish and a second portion being connected to said first portion by inner and outer shoulders of said closure skirt and terminating at a skirt open end opposite of said base wall and being stepped to extend radially outwardly from said first portion and having an outer diameter larger than that of said first portion and having an inner diameter larger than that of said first portion, a spring element for urging said closure away from said finish, and at least one pair of internal lugs separate from said internal thread and being carried on said second portion, said at least one pair of internal lugs on said skirt being adjacent to but circumferentially spaced from each other, and being comprised of a trailing internal lug and a leading internal lug disposed clockwise of said trailing internal lug as viewed from above said package, and said leading internal lug being positioned proximate and just axially above said skirt open end and said trailing internal lug being positioned proximate and just axially below said inner shoulder of said closure skirt there being one pair of internal lugs on said skirt for each external lug on said finish, said leading internal lug having an axially oriented cam face sloping toward said base wall such that threading said closure onto the container finish causes said leading internal lug on said closure skirt to cam axially away from the open end of the container finish relative to said external lug on said container finish by compression of the spring element such that said leading internal lug cams over said external lug as said closure is threaded onto said finish against a force supplied by said spring element to said finish until said external lug on said finish is received between said at least one pair of internal lugs on said skirt and said trailing internal lug on said skirt engages said external lug to prevent further threading of said closure onto said finish, removal of said closure from said finish requiring urging said closure onto said finish against the force of said spring element until said leading internal lug on said skirt is disposed beneath said external lug and permits unthreading of said closure from said finish.

15. A closure for a child-resistant package, including:

a base wall, and a skirt extending from said base wall and having a stepped profile that includes:

a first portion on which is disposed at least one internal thread, and a second portion being connected to said first portion by inner and outer shoulders, terminating at a skirt open end opposite of said base wall, being stepped to extend radially outwardly from said first portion, and having:

an outer diameter larger than that of said first portion, and an inner diameter larger than that of said first portion and on which is disposed at least one pair of internal lugs extending radially inwardly and including:

a first lug positioned proximate and just axially above said skirt open end, and second lug circumferentially spaced from said first lug and positioned proximate and just axially below said inner shoulder of said closure skirt, and at least one spring element extending from at least one of said base wall or said skirt for urging said closure away from a container, wherein said at least one internal thread is adapted for engagement with at least one external thread of the container, wherein said first lug is adapted for cooperation with a stop lug on the container to prevent unthreading of said closure from the container absent pressure on said closure against said spring element to push said first lug on said skirt beneath the stop lug on the container, wherein said second lug is adapted for cooperation with the stop lug on the container to limit the threading of the closure onto the container, and wherein said spring element includes a plurality of circumferentially spaced spring segments, and said closure also includes a plurality of axially extending spring stops to limit flexing of said spring element.

* * * * *